US006176756B1

(12) United States Patent
Panec

(10) Patent No.: US 6,176,756 B1
(45) Date of Patent: Jan. 23, 2001

(54) PLUSH CONSTRUCTION SET

(75) Inventor: Donald J. Panec, South San Francisco, CA (US)

(73) Assignee: Treasure Bay, Inc., S. San Francisco, CA (US)

( * ) Notice: Under 35 U.S.C. 154(b), the term of this patent shall be extended for 0 days.

(21) Appl. No.: 09/340,173

(22) Filed: Jun. 25, 1999

(51) Int. Cl.[7] ..... A63H 3/16
(52) U.S. Cl. ..... 446/99; 446/321; 446/373
(58) Field of Search ..... 446/85, 87, 99, 446/100, 101, 268, 321, 373, 374; 428/4, 5; 472/133

(56) References Cited

U.S. PATENT DOCUMENTS

| | | | | |
|---|---|---|---|---|
| D. 155,978 | | 11/1949 | Fine . | |
| 1,657,744 | | 1/1928 | Durkee . | |
| 2,044,949 | | 6/1936 | Levy et al. . | |
| 2,193,522 | * | 3/1940 | Ross | 446/374 |
| 2,516,479 | * | 7/1950 | Opel | 446/373 |
| 2,812,616 | | 11/1957 | Ford . | |
| 3,068,487 | | 12/1962 | Hain . | |
| 3,333,349 | | 8/1967 | Brumlik . | |
| 3,458,959 | | 8/1969 | Young . | |
| 3,560,313 | * | 2/1971 | Herkimer | 428/4 |
| 3,590,516 | | 7/1971 | Dunn . | |
| 4,123,872 | | 11/1978 | Silva . | |
| 4,476,167 | * | 10/1984 | Duftler | 428/4 |
| 4,929,215 | | 5/1990 | Lovik | 446/226 |
| 5,195,917 | * | 3/1993 | Russell et al. | 446/97 |

FOREIGN PATENT DOCUMENTS

| | | | | |
|---|---|---|---|---|
| 452749 | * | 5/1950 | (IT) | 446/100 |
| 465534 | * | 3/1952 | (IT) | 446/99 |

OTHER PUBLICATIONS

Picture of LEGO–type interlocking building blocks.
Picture of Tinkertoy building set. with detail of instruction sheet.
Picture of Mister Potatohead toy.

* cited by examiner

*Primary Examiner*—John A. Ricci
(74) *Attorney, Agent, or Firm*—Kolisch Hartwell Dickinson McCormack & Heuser

(57) ABSTRACT

A plush construction set including a first plush object and a second plush object. A first connecting element is secured to the first plush object, and a second connecting element is secured to the second plush object. The first and second connecting elements are at least semi-rigid. The first and second connecting elements are configured to establish a releasable connection between the first and second plush objects. At least one of the first and second objects may have a plurality of fibrous elements that extend in a plurality of directions. The fibrous elements may be made of yarn, fur, hair, synthetic fiber resembling hair, thread, thin strips of cloth or other textiles, or the like. Decorative features resembling body features may be attached to the first or second plush objects.

28 Claims, 4 Drawing Sheets

Fig. 7
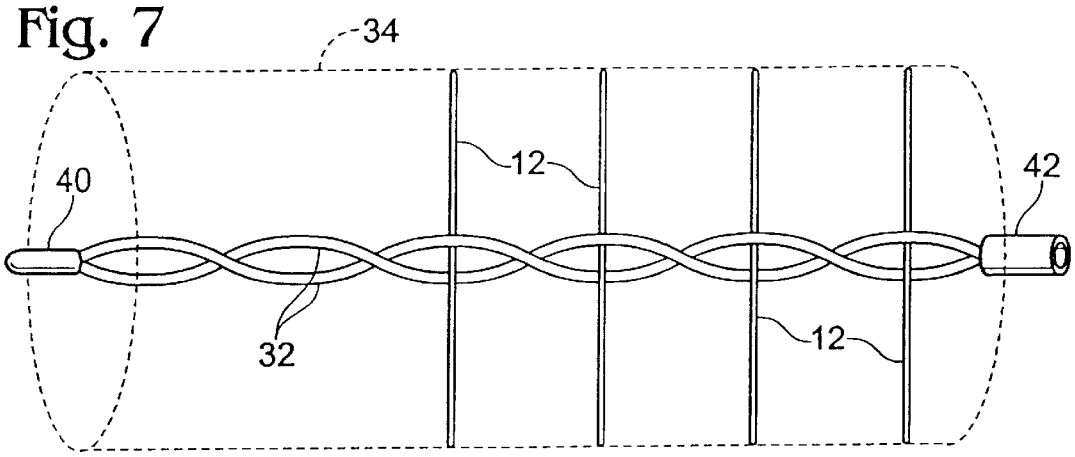
Fig. 12
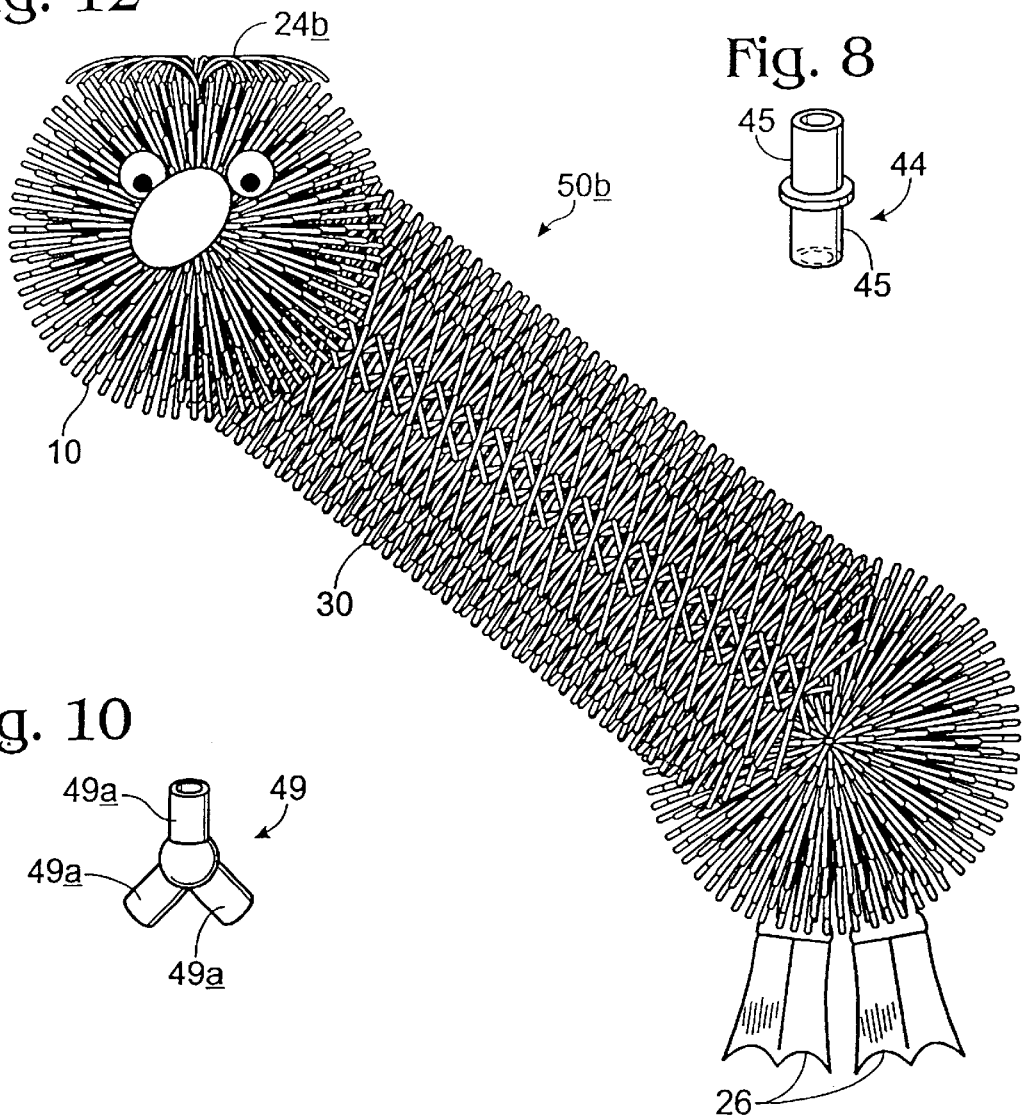
Fig. 8
Fig. 10

PLUSH CONSTRUCTION SET

FIELD OF THE INVENTION

The present invention relates generally to toy construction sets. More particularly, the present invention relates to a construction set having plush and non-plush components.

BACKGROUND OF THE INVENTION

Construction sets, which include differently-sized components that are configured to be assembled by a child, are fun and educational toys for children of differing age groups. Construction sets help develop small-motor skills and stimulate creativity. One type of construction set, sold under the trademark LEGO, includes a plurality of small molded plastic components that are stackable upon each other, like small bricks, to create a desired object. The upper side of each component has at least one protruding element that interlocks with a recessed construction in the underside of other components. Another type of construction set, sold under the trademark TINKERTOY, comprises a plurality of shafts and hubs that may be attached and configured in many different ways. These construction sets are made from wood or hard plastic and are designed to build objects such as machinery, buildings, or vehicles. The angular or mechanical characteristics of such construction sets are not optimal if it is desired to construct an object resembling an animal, doll or whimsical creature.

Yet another type of construction set, sold under the trademark MISTER POTATO HEAD, includes a molded hard plastic "head" that may be adorned with plastic eyes, ears, etc. to resemble a face. However, it is not possible to vary the shape of the hard plastic "head," or to create a soft object resembling an animal or doll.

SUMMARY OF THE INVENTION

The present invention provides a plush construction set including a first plush object and a second plush object. A first connecting element is secured to the first plush object, and a second connecting element secured to the second plush object. The first and second connecting elements are at least semi-rigid. The first and second connecting elements are configured to establish a releasable connection between the first and second plush objects. The releasable connection may be established by a joining member configured to join the first and second connecting elements. At least one of the first and second plush objects may have a plurality of fibrous elements that extend in a plurality of directions. The fibrous elements may be made of yarn, fur, hair, synthetic fiber resembling hair, thread, thin strips of cloth or other textiles, or the like. Decorative features resembling body features may be attached to the first or second plush objects. The invention may also provide a pompon to which objects may be releasably connected.

BRIEF DESCRIPTION OF THE DRAWINGS

FIG. 7 is a top plan view of the embodiment of FIG. 6 as it is being made.

FIG. 8 is an isometric view of a joining component usable with the invention.

FIG. 10 is an isometric view of a three-way joining component usable with the invention.

FIG. 12 is an isometric view of another assembly made with the plush objects of the invention.

DETAILED DESCRIPTION OF THE DRAWINGS AND BEST MODE FOR CARRYING OUT THE INVENTION

As stated above, the invention is a plush construction kit wherein plush objects are combined to create a variety of objects. As the invention may take many forms, the invention will first be described in a basic form, and several variations on the basic form will then be described.

Figure 1:
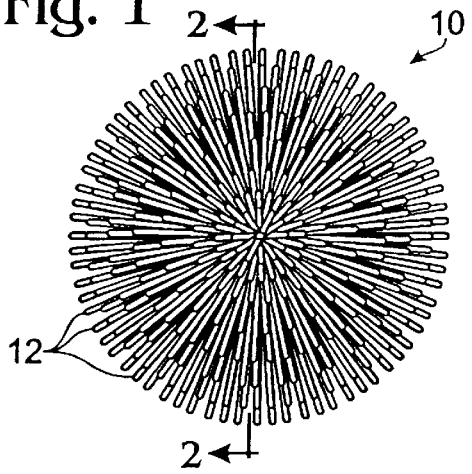
FIG. 1 is a front elevational view of a plush object of the present invention.
Figure 2:
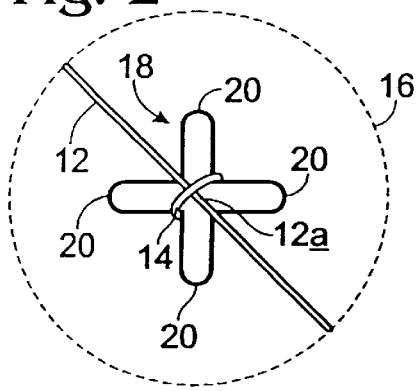
FIG. 2 is a simplified sectional view taken along the line 2—2 in FIG. 1.

Referring to FIGS. 1 and 2, a first object is indicated generally by reference number 10. First object 10 may be constructed by providing a plurality of fibrous elements, which may include elongate strands 12 of a fibrous material such as yarn or other woven material, string, thread, hair, fur, or artificial fibers that resemble hair or fur. Strands 12 are held together by an anchoring system such as a clasp 14, which in FIG. 2 is depicted as a wire ring that compresses and holds the strands at substantially the midsection 12*a* of the strands such that the plurality of strands will extend in a plurality of directions from clasp 14 to define the shape of the first object. For the sake of clarity, only one strand 12 is shown in FIG. 2, it being understood that a plurality of strands 12 are normally provided to construct the first object. If all of strands 12 used in the embodiment shown in FIG. 1 have substantially the same length, the first object will have a substantially spherical shape resembling a pompon as shown by the dashed outline 16. Other shapes are possible and are contemplated as being within the scope of the invention.

A first connecting element 18 is disposed within first object 10. First connecting element 18 is depicted in FIG. 2 as a cross-shaped assembly having a plurality of extensions, pegs or posts 20. Each post is at least semi-rigid or rigid and is configured to extend in a direction that is accessible to a user. Clasp 14 surrounds the center of first connecting element 18 and secures the first connecting element within the first object. A second connecting element, shown in FIG. 3 as a receptor or socket 22, is associated with a second object and is designed to have a shape complementary to posts 20. Sockets 22 are configured to be rigid or at least semi-rigid, extend in a direction that is accessible to a user, and are shaped to fit upon or mate with one of the posts and remain thereon until removed by a user. In the depicted embodiment, each socket frictionally fits upon a post, but a screw-fit, snap-fit or other type of fit may also be used. These and other types of fits and connections may also be used with the other embodiments described herein. Preferably, posts 20 are hidden within strands 12.

Figure 3:
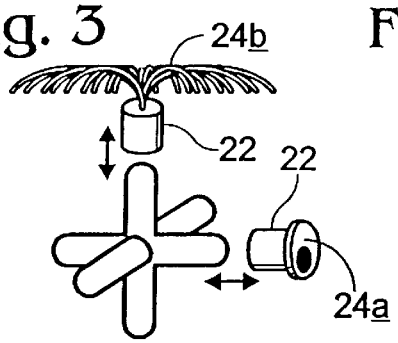
FIG. 3 is an isometric view of another connecting structure usable with the invention.

Socket 22 may be attached to a second plush object or it may have a decoration object attached thereto. The decoration objects may resemble a body part, such as an eye 24*a* or a tuft of hair 24*b* as depicted in FIG. 3. Other decoration objects usable with the invention may resemble a nose, mouth, ears, feet, arms, legs, hands, other body parts, jewelry, decorations, and the like.

Figure 4:
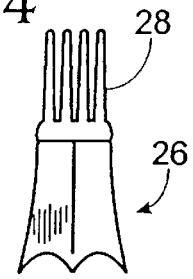
FIG. 4 is a top plan view of a feature usable with the invention.
Figure 5:
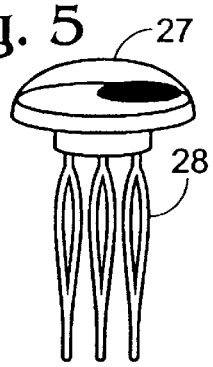
FIG. 5 is a top plan view of a feature usable with the invention.

The construction set is used by attaching plush objects together and by attaching decoration objects to the plush objects. A plurality of connecting elements in a plush object permit a corresponding plurality of objects to be attached to the plush object. Additionally, decoration objects such as the webbed foot 26 shown in FIG. 4 or the eye 27 of FIG. 5 may be secured to a comb 28 and be attached to a plush object by inserting the comb into strands 12. The comb in FIG. 5 includes tines that are shaped to help hold the comb in place. Other attachment mechanisms such as pins, clips or alligator clips may also be used to attach decoration objects to plush objects. A user may therefore assemble a plush creation using the construction kit of the present invention.

Figure 6:
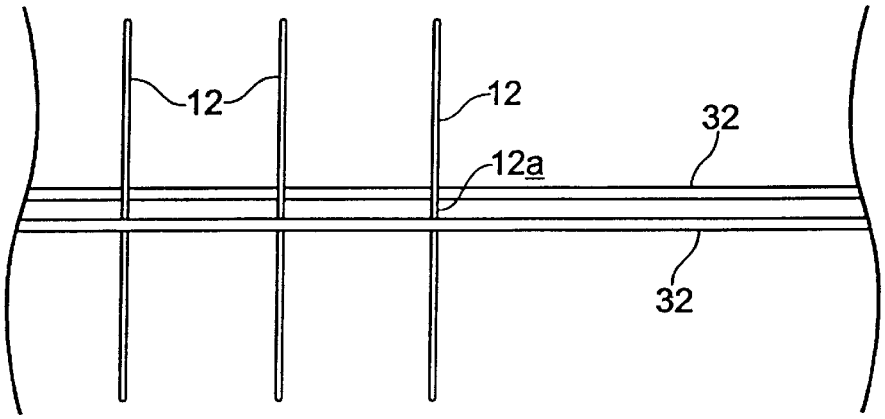
FIG. 6 is a top plan view of another embodiment of a plush object of the invention as it is being made.

FIGS. 6 and 7 depict a method of making a second type of object according to the present invention. A pair of bendable wires 32 are disposed parallel to each other. A plurality of strands 12 are disposed between wires 32. For the sake of clarity FIGS. 6 and 7 depict only a few strands 12. The midsections 12*a* of the strands 12 are anchored or secured between wires 32 by twisting the wires, as shown in FIG. 7. The strands extend from the wires in a plurality of directions. If strands 12 have substantially equal lengths, the second object is substantially cylindrical as indicated by the dashed outline 34 in FIG. 7, and as shown at 30 in FIG. 12. Wires 32 are bendable and may be made of a material that permits the object to maintain a bent or straight shape as desired by a user. Wires 32 may be covered or encased in plastic and capped on their respective ends. A connecting element, such as a post 40 or a socket 42, is provided on at least one end of the second object. Decoration objects may be attached to second object 30 using post 40 or socket 42 or by placing the decoration objects on or within strands 12 as previously described.

Figure 9:
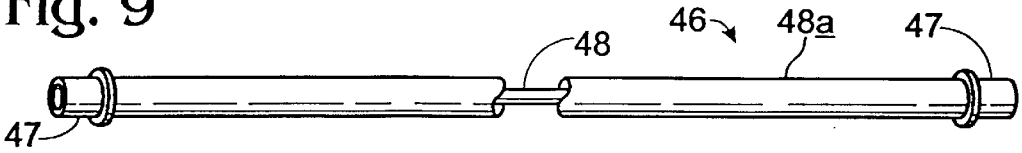
FIG. 9 is an isometric view of an elongate joining component usable with the invention.

A joining member 44, shown in FIG. 8, may be used to join plush objects having posts to form a composite plush object. According to one embodiment, joining member 44 is a rigid or at least semi-rigid extension and has two sockets 45 that frictionally or otherwise fit around the posts of different objects. FIG. 9 shows an elongate joining member 46 with sockets 47 at distal ends and a bendable wire 48 encased in flexible plastic tubing 48*a* disposed intermediate the connectors. Sockets 47 may be fitted onto posts of different objects. Bendable wire 48 may also be bent to permit sockets 47 to connect to the posts of a single object. FIG. 10 shows a joining member 49 with three sockets 49*a* disposed thereon and used in a manner similar to joining member 44 shown in FIG. 8. Other arrangements and types of joining members may be used. For instance, an elbow-shaped joining member, in which sockets are angled with respect to each other, may be provided. A U-shaped joining member may also be provided. The joining member also may include two or more posts that are configured to releasably connect sockets disposed on different plush objects. In other words, the joining members may be thought of as having two or more male connecting elements, two or more female connecting elements or combinations of male and female connecting elements.

Figure 11:
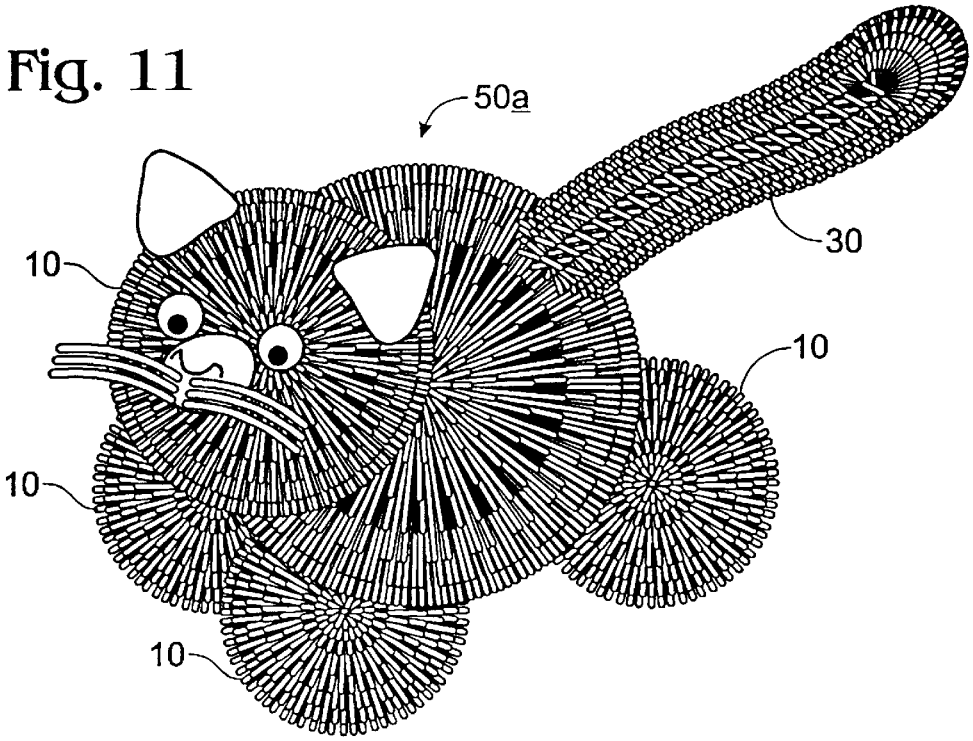
FIG. 11 is an isometric view of an assembly made with the plush objects of the invention.

A user may use any of the above mentioned connection strategies to combine a plurality of objects to create various assemblies. The assemblies may be constructed to resemble animals such as a cat 50*a*, as shown in FIG. 11, whimsical creatures such as the one shown in FIG. 12 at 50*b*, clothing accessories, dolls, or other items. As with previous embodiments, decoration objects may be added to enhance the assembly's resemblance to known items or simply for decoration.

The connection between connecting elements such as a post and a socket is such that the post and socket may be rotated with respect to each other while maintaining a connection therebetween. This means that objects attached to the post and socket are rotatable with respect to each other. Furthermore, the connection between the posts and sockets may be designed to have enough friction to prevent rotation unless a user rotates the connection. Objects may therefore be positioned or posed as desired with respect to each other.

Figure 13:
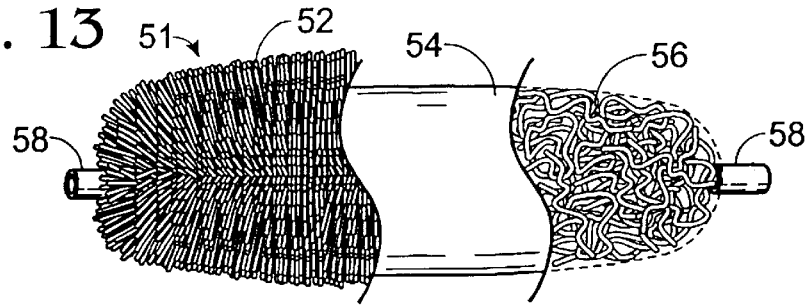
FIG. 13 is an isometric view of another embodiment of the invention, with part of the invention being cut away to show the inner construction of the embodiment.
Figure 14:
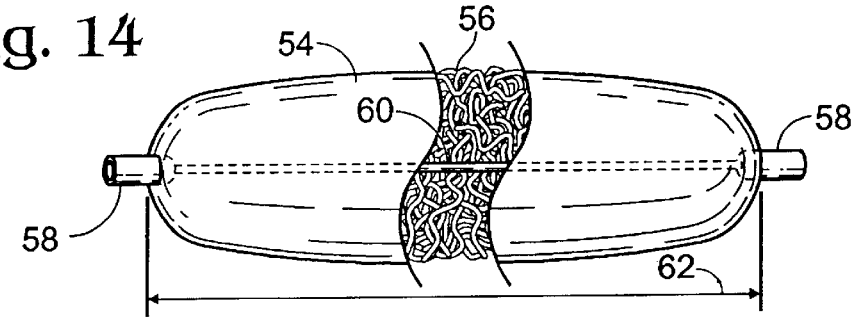
FIG. 14 is an isometric view of another embodiment of the invention, the figure having a portion cut away to view the inner construction of the embodiment.
Figure 15:
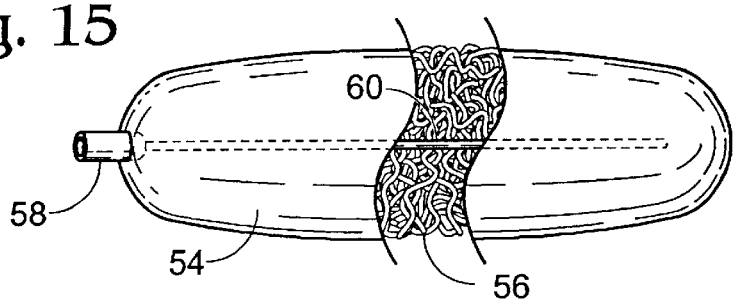
FIG. 15 is an isometric view of yet another embodiment of the invention, the figure having a portion cut away to view the inner construction of the embodiment.

FIG. 13 shows an object 51 constructed according to another embodiment in which a plurality of hair-like strands 52 extend from a fabric covering or enclosure 54. The fabric enclosure is filled with stuffing 56 that may take the form of beads, fibrous padding, batting, or the like. Fabric enclosure 54 is depicted as being elongate, although other shapes and forms are within the scope of the invention. Fabric enclosure 54 includes at least one connecting element 58 that is used in a manner similar to connecting elements 20, 22, 40, 42 in previous embodiments. As depicted in FIG. 14, fabric enclosure 54 may also include a stiffener, such as a wire 60, to maintain the shape of the fabric enclosure. Wire 60 may be bendable to permit the user to shape the fabric enclosure as desired. Decoration objects may be used with this embodiment as previously described. Wire 60 may extend through an elongate dimension 62 of the fabric enclosure and have the connecting elements secured thereto. Alternately, wire 60 may pass only partially through fabric enclosure 54, as shown in FIG. 15. It is also possible to have no stiffener disposed within the fabric enclosure, as shown in FIG. 13. Lastly, fabric enclosure 54 may not include strands 52, as shown in FIG. 15. Each of these variations are contemplated as being within the scope of the invention.

The objects disclosed in the different embodiments may all be considered plush objects. A plush object, as used herein, refers to objects having a plurality of fibrous elements extending in many directions, such as those shown in FIGS. 1 and 11–13 objects having a covering made of cloth or other fibrous material, such as those shown in FIGS. 13–15, and objects that are padded or stuffed and that have a soft, fibrous or fabric covering. Each type of plush object presents various advantages.

It can be seen from the figures that the connecting elements, joining members and anchoring systems comprise an interconnectable stiffening system that provides rigidity and support to assemblies made with the invention. This poseable skeleton-like system permits the assembly of soft plush creations while ensuring that the creations maintain the desired shapes.

Figure 16:
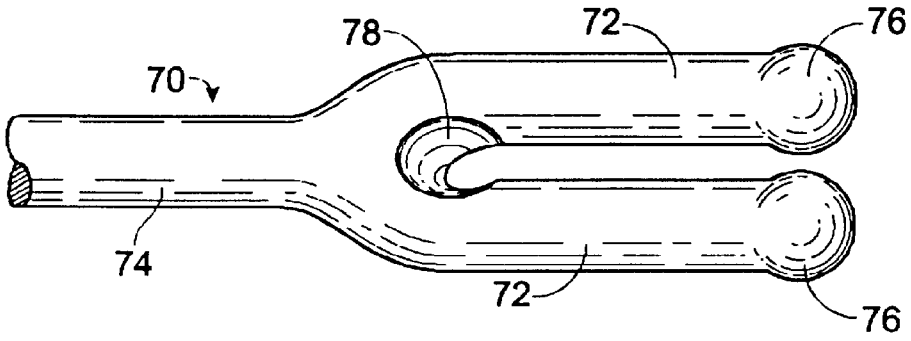
FIG. 16 is an isometric view of another type of connector usable with the invention.
Figure 17:
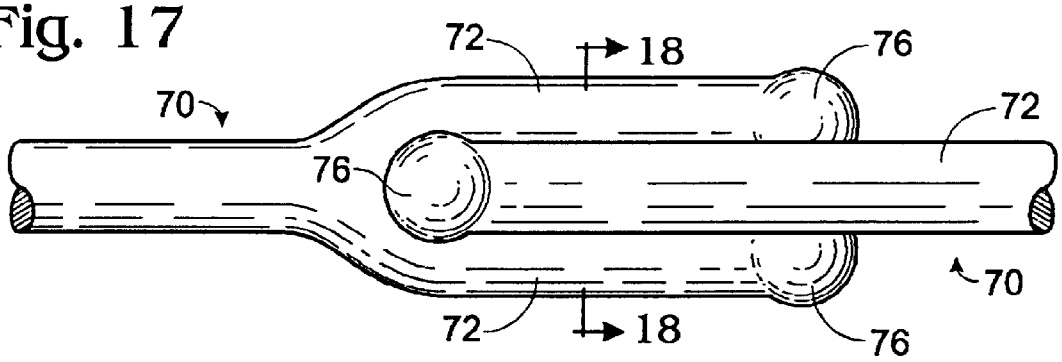
FIG. 17 is a side elevational view of a pair of the connectors of FIG. 16.
Figure 18:
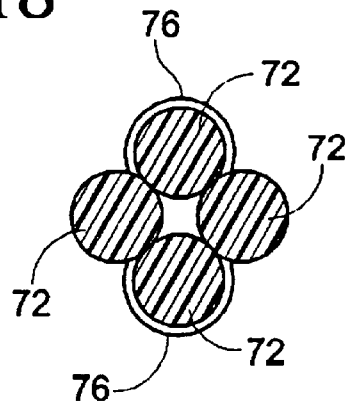
FIG. 18 is a sectional view taken along 18—18 in FIG. 17.

FIGS. 16–18 show another type of connector 70 that may be used with the embodiments of the invention. The connector is generally U-shaped, similar to the shape of a tuning fork, and is made of a resilient material. Connector 70 has a pair of extensions or posts 72 extending from a base 74. Base 74 is connected to a plush object (not shown). Posts 72 have enlarged or substantially spherical ends 76. Each end 76 has a diameter that is larger than the thickness of each post 72. A depression 78 is formed in base 74. As shown in FIG. 17, two connectors 70 may be placed together by orienting the connectors so that the plane of the posts of each connector are substantial perpendicular to each other. Ends 76 of the connectors are brought into contact with each other, and the connectors are urged toward each other. The enlarged ends of each connector slide along the posts of the other connector until the ends of the connectors "snap" into depressions 78 of the other connector. As shown in FIG. 17, posts 72 contact each other along their respective lengths and ends 76 fit into depressions 78, thereby providing a connection between plush objects secured to the connectors. Connectors 70 are separated from each other by pulling the connectors apart in a direction substantially parallel to posts 72. Ends 76 initially resist being removed from depressions 78, but once removed therefrom, the connectors easily slide apart. FIG. 18 shows a cross-sectional view taken along the line 18—18 in FIG. 17. FIG. 18 shows how the posts fit together, and it shows the spacing between the posts.

The invention may be modified in many ways. First connecting element 18 may include any number of posts, such as the four posts shown in FIG. 2 or the six posts depicted in FIG. 3. The first connecting element may have a combination of posts and/or sockets to enhance the connecting options available to a user. The posts are depicted as being disposed inside the outline of the first object, but may extend beyond the outline. Cylindrical object 30 may be varied by tapering the length of the strands between opposite ends of the object, thereby forming a conical or frustoconical object. More than two wires 32 may be used to anchor the strands inside object 30. Joining components 44, 46, and 49 may be angled so that the sockets extend from each other at angles that are different from what is shown in the figures. The connecting elements may take forms other than the male-female post and socket combination shown in the Figures. As previously stated, the connecting elements may include a combination of rigid or semi-rigid posts, wherein a releasable connection is established therebetween. The connecting elements may also provide an interlocking connection between objects.

An advantage of the invention is that a user may create unique plush toys by combining and decorating various objects. The resulting toy will have all the advantages and attraction of plush toys, with the added attraction of being created by the user. Thus a user may design and create plush animals, teddy bears, dolls, objects, etc., and change the configuration or appearance of the toys over time. Another advantage is that the softness of the objects provides an attractive play experience for young children. Another advantage is that the construction set stimulates creativity in designing plush items. The invention therefore provides a construction set that appeals to many young girls, who may not otherwise be interested in construction sets. Yet another advantage is that the plush objects and features are inexpensive to manufacture. Still another advantage is that the bendable embodiments of the invention permit a user to shape and pose a creation as desired. Still another advantage is that in some of the embodiments, the connecting elements allow objects to rotate relative to each other while maintaining a connection between the elements. This permits creations made with the invention to be posed as desired. Still another advantage is that the connecting structure may be hidden inside the objects. This prevents the connecting structure from detracting from the appearance of a finished creation. Still another advantage is that the connecting structure provides easy and rapid interchangeability of parts. The plush objects may therefore be connected together in a variety of ways to make larger and more complex creations.

While the invention has been disclosed in its preferred form, the specific embodiments thereof as disclosed and illustrated herein are not to be considered in a limiting sense as numerous variations are possible. Applicant regards the subject matter of the invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or presentation of new claims in this or a related application. Such claims are also regarded as included within the subject matter of applicant's invention irrespective of whether they are broader, narrower, or equal in scope to the original claims.

I claim:

1. A plush construction set, comprising:

a first plush object;

a second plush object;

a first connecting element secured to the first plush object, wherein the first connecting element is at least semi-rigid;

a second connecting element secured to the second plush object, where the second connecting element is at least semi-rigid; and where the first and second connecting elements are at least part of a releasable connection between the first and second plush objects.

2. The plush construction set of claim 1, further comprising a decoration object that is attachable to one of the first and second plush objects.

3. The plush construction set of claim 2, wherein the decoration object includes a comb configured to attach the decoration object to one of the first and second plush objects.

4. The plush construction set of claim 1, wherein the first connecting element comprises a post, and wherein the second connecting element comprises a socket adapted to create a removable fit with the post.

5. The plush construction set of claim 1, wherein the first and second connecting elements comprise extensions.

6. The plush construction set of claim 1, further comprising a joining member to releasably connect the first and second connecting elements.

7. The plush construction set of claim 1, wherein the first and second connecting elements comprise posts, and further comprising a joining member to releasably connect the posts.

8. The plush construction set of claim 1, wherein the first and second connecting elements comprise sockets, and further comprising a joining member to releasably connect the sockets.

9. The plush construction set of claim 1, wherein the first plush object includes fibrous elements that define an outer surface of the object, and wherein the first connecting element is configured to be disposed interior of the outer surface.

10. The plush construction set of claim 1, wherein the first plush object has a plurality of fibrous elements extending in a plurality of directions.

11. The plush construction set of claim 10, wherein the first plush object is a pompon.

12. The plush construction set of claim 10, wherein the first plush object includes an anchoring system that holds the fibrous elements to define a shape.

13. The plush construction set of claim 12, wherein the anchoring system includes at least one wire configured to be bendable and capable of maintaining a desired configuration, and further wherein the shape of the first plush object may be varied by bending the at least one wire.

14. The plush construction set of claim 10, wherein the fibrous elements are made from one or more of yarn, string, thread, hair, fur, artificial hair, and artificial fur.

15. The plush construction set of claim 1, wherein the first object includes at least a portion having a fabric enclosure.

16. A plush construction set, comprising:

a pompon;

a second object; and a connecting structure configured to establish a releasable connection between the pompon and the second object without deformation of the connecting structure so that the pompon and second object may be selectively and repeatedly connected and disconnected.

17. The plush construction set of claim 16, wherein the connecting structure includes a connecting element that is at least semi-rigid and that is attached to the pompon.

18. A plush construction set, comprising: a pompon;

a second object; and a connecting structure configured to establish a releasable connection between the pompon and the second object;

wherein the second object is a decoration object, and the decoration object includes a comb configured to attach the decoration object to the pompon.

19. A plush construction set, comprising:

a first plush object;

a second plush object; and connecting structure associated with the first and second plush objects, the connecting structure being configured to establish a releasable connection between the first and second plush objects, wherein the connecting structure includes an at least semi-rigid extension.

20. The plush construction set of claim 19, wherein the connecting structure comprises:

a first connecting element secured to the first plush object; and a second connecting element secured to the second plush object;

where the first and second connecting elements are configured to fit together to establish a releasable connection between the first and second plush objects; and where at least one of the first and second connecting elements includes the at least semi-rigid extension.

21. The plush construction set of claim 19, wherein the first plush object has a plurality of fibrous elements extending in a plurality of directions, the first plush object further including an anchoring system that holds the fibrous elements to define a shape.

22. The plush construction set of claim 21, wherein the anchoring system includes a plurality of wires, and wherein the fibrous elements are held between the wires to define the shape of the first plush object.

23. The plush construction set of claim 22, wherein the wires are bendable and are capable of maintaining a desired configuration, and further wherein the shape of the first plush object may be varied by bending the wires.

24. The plush construction set of claim 19, wherein the first plush object has a plurality of fibrous elements made from one or more of yarn, string, thread, hair, fur, artificial hair, and artificial fur.

25. A plush construction set comprising a plurality of plush objects being releasably connectable to each other in a plurality of configurations to construct amusement items therefrom, wherein the plush objects are connectable by virtue of at least semi-rigid members associated with the plush objects and that fit together to provide support for the resulting amusement items.

26. A plush construction set, comprising:

a plurality of plush objects configured to be releasably connected to create a composite plush object; and an at least semi-rigid framework that is disposed substantially within the composite object, wherein the framework provides support to the composite object, and wherein the framework includes a plurality of sections that releasably interconnect so that the sections may be selectively and repeatedly connected and disconnected to releasably connect and disconnect the plurality of plush objects.

27. A plush construction set, comprising:

a plurality of plush objects configured to be releasably connected to create a composite plush object; and an at least semi-rigid framework that is disposed substantially within the composite object, wherein the framework provides support to the composite object, wherein the framework is configured to releasably connect the plurality of plush objects, and wherein the framework includes posts and sockets configured so that the posts fit in the sockets.

28. A plush construction set, comprising:

a first plush object;

a second plush object; and means for releasably connecting the first and second plush objects so that be created, wherein the means includes an at least semi-rigid extension.

* * * * *

UNITED STATES PATENT AND TRADEMARK OFFICE

CERTIFICATE OF CORRECTION

PATENT NO. : 6,176,756 B1
DATED : January 23, 2001
INVENTOR(S) : Donald J. Panec It is certified that error appears in the above-identified patent and that said Letters Patent is hereby corrected as shown below:

Column 8,
Line 52, after "objects so that" insert -- an assembly may -- therefor.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*